US006629618B1

(12) United States Patent
Volan

(10) Patent No.: US 6,629,618 B1
(45) Date of Patent: Oct. 7, 2003

(54) THERMALLY INSULATED GLASS BOTTLE

(76) Inventor: Ken Michael Volan, 11500 Aaron Dr., Parma, OH (US) 44130

( * ) Notice: Subject to any disclaimer, the term of this patent is extended or adjusted under 35 U.S.C. 154(b) by 0 days.

(21) Appl. No.: 10/172,129

(22) Filed: Jun. 14, 2002

Related U.S. Application Data

(63) Continuation-in-part of application No. 09/777,991, filed on Feb. 6, 2001, now Pat. No. 6,405,892.

(51) Int. Cl.[7] ..... B65D 6/10
(52) U.S. Cl. ..... 215/12.1; 220/592.17
(58) Field of Search ..... 215/12.1; 220/592.17, 220/592.23, 592.24, 23.91

(56) References Cited

U.S. PATENT DOCUMENTS 2,725,733 A * 12/1955 Davis ..... 220/592.17 X
2,895,636 A * 7/1959 Martin ..... 215/12.1 X
3,156,279 A * 11/1964 Grebowiec et al. ..... 215/12.1
3,766,975 A * 10/1973 Todd ..... 215/12.1 X
4,007,670 A * 2/1977 Albano et al.
4,632,273 A * 12/1986 Rhine
4,720,023 A * 1/1988 Jeff
5,005,717 A * 4/1991 Dilar
5,253,780 A * 10/1993 Adado
5,261,554 A * 11/1993 Forbes
D372,168 S * 7/1996 Seager
6,010,062 A * 1/2000 Shimono
6,050,443 A * 4/2000 Tung ..... 220/592.17
6,308,846 B1 * 10/2001 Müller ..... 220/592.17 X
6,405,892 B1 * 6/2002 Volan ..... 220/592.17

* cited by examiner

*Primary Examiner*—Steven Pollard
(74) *Attorney, Agent, or Firm*—John D. Gugliotta

(57) ABSTRACT

A thermally insulated glass bottle is provided as an insulated glass bottle made from glass with an interstitial space in the sides and bottom. The sides and bottom of the glass are double-walled, forming an interstitial space for insulating purposes. The interstitial space can be left filled with air, or filled with an insulating material such as Styrofoam®. The interstitial space not only reduces or eliminates condensation from forming on the exterior of the glass when filled with cold liquid on hot, humid days, but it also helps keep the liquid cooler.

12 Claims, 3 Drawing Sheets

THERMALLY INSULATED GLASS BOTTLE

RELATED APPLICATIONS

The present invention in a Continuation in Part of U.S. application Ser. No. 09/777,991, filed on Feb. 6, 2001, and now issued as U.S. Pat. No. 6,405,892 on Jun. 18, 2002, the disclosure of which in fully incorporated herein as if fully rewritten.

BACKGROUND OF THE INVENTION

1. Field of the Invention

The present invention relates generally to insulated drinking containers and, more particularly, to a thermally insulated beverage bottle.

2. Description of the Related Art

Nothing is more refreshing on a hot day than a cold beverage such as ice tea, soda, beer, ice water or the like. However, one must deal with the "sweating" or condensation that forms on the exterior of a bottle. This sweating may leave puddles on the table, which,may cause damage if the table is made of wood. The condensation also causes a safety problem should the bottle slip from ones hand when picking it up. One method of reducing such problems is the use of insulated plastic bottles. While plastic bottles with insulating walls do cut down on condensation on the exterior of the bottle, many people do not like plastic, due to its cheaper feel, and would as such, not be used in finer restaurants.

Accordingly, a need has developed for bottles made from glass, so that cold beverages can be enjoyed without glass condensation problems. The development of the thermally insulated beverage glass fulfills this need.

A search of the prior art did not disclose any patents that read directly on the claims of the instant invention; however, the following references were considered related. The following patents disclose the design and function of an insulated drinking cup or container: U.S. Pat. No. 6,010,062 issued in the name of Shimono; U.S. Pat. No. 5,261,554 issued in the name of Forbes; U.S. Pat. No. 5,253,780 issued in the name of Adado; U.S. Pat. No. 5,005,717 issued in the name of Oilar; U.S. Pat. No. 4,007,670 issued in the name of Albano et al.; and U.S. Pat. No. D 372,168 issued in the name of Seager.

U.S. Pat. No. 4,720,023 issued in the name of Jeff describes a combination insulated mug and beverage can holder.

U.S. Pat. No. 4,632,273 issued in the name of Rhine discloses a disposable insulated container and drinking cup combination.

U.S. Pat. No. 4,151,923 issued in the name of Bernardi describes a thermally insulated pre-chill drinking glass.

Consequently, a need has been felt for providing a device which provides a means to enjoy a cold beverage without the aggravations and disadvantages of condensation or sweating.

SUMMARY OF THE INVENTION

Therefore, it is an object of the present invention to provide a glass bottle which is great for cold beverages such as beer, soda, tea, water and the like.

It is another object of the present invention to provide a glass bottle which eliminates or reduces condensation on the outside of the glass.

It is still another object of the present invention to provide a glass bottle with double walls which provides an insulating, interstitial space.

It is still another object of the present invention to provide a glass bottle with double walls which keeps the outer wall at a warmer temperature so as to keep the glass bottle from sweating.

It is another object of the present invention to provide a glass bottle with double walls which keeps beverages colder.

It is another object of the present invention to provide a glass bottle with double walls which prevents one's hands from warming the beverage as well.

It is another object of the present invention to provide an interstitial space which can be left filled with air, thus forming a vacuum therein.

It is another object of the present invention to provide an interstitial space which can be filled with Styrofoam®, or other insulating material to further enhance insulating qualities.

It is another object of the present invention to provide an interstitial space which can be filled with decorative insulating material as well for aesthetic qualities.

It is another object of the present invention to provide a smooth rim which presents no danger to the user.

Briefly described according to one embodiment of the present invention, a thermally insulated beverage bottle is an insulated glass bottle made from glass with an interstitial space in the sides and bottom. Upon initial observation, the invention looks remarkably like a conventional glass bottle. But after closer inspection, it can be seen that the sides and bottom of the bottle are double-walled, forming an interstitial space for insulating purposes. The interstitial space can be left filled with air, or filled with an insulating material such as Styrofoam®. Other decorative insulating materials can be placed in the interstitial space as well. An optional hemispherical member, located on the bottom of the inner side wall of the glass bottle, is used to increase structural integrity of the bottle. The interstitial space not only reduces or eliminates condensation from forming on the exterior of the bottle when filled with cold liquid on hot, humid days, but it also helps keep the liquid cooler.

The use of the present invention provides a means to enjoy a cold beverage without the aggravations and disadvantages of condensation or sweating.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
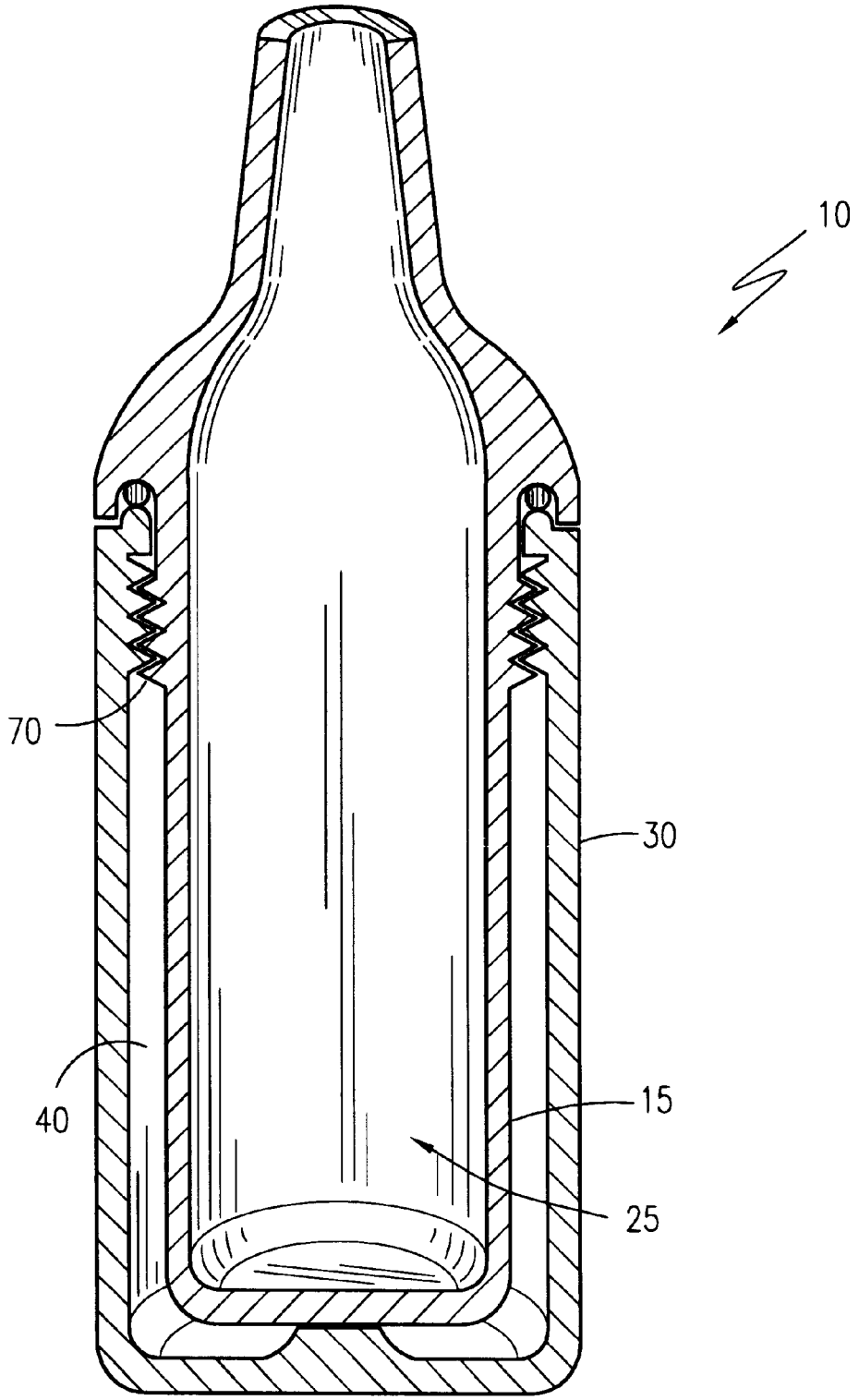
FIG. 1 is a side elevational cross sectional view of a thermally insulated bottle according to the preferred embodiment of the present invention.
Figure 2:
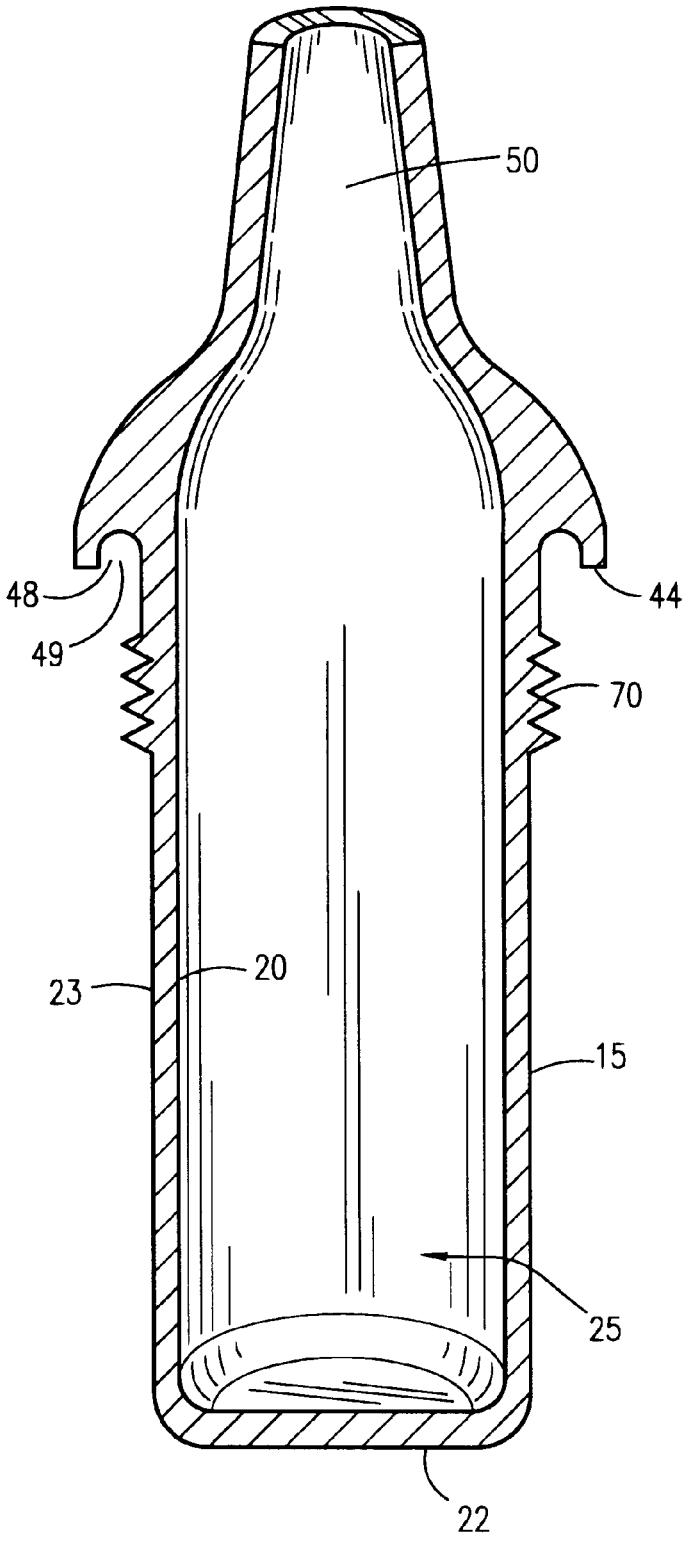
FIG. 2 is a side elevational view of an inner bottle member.
Figure 3:
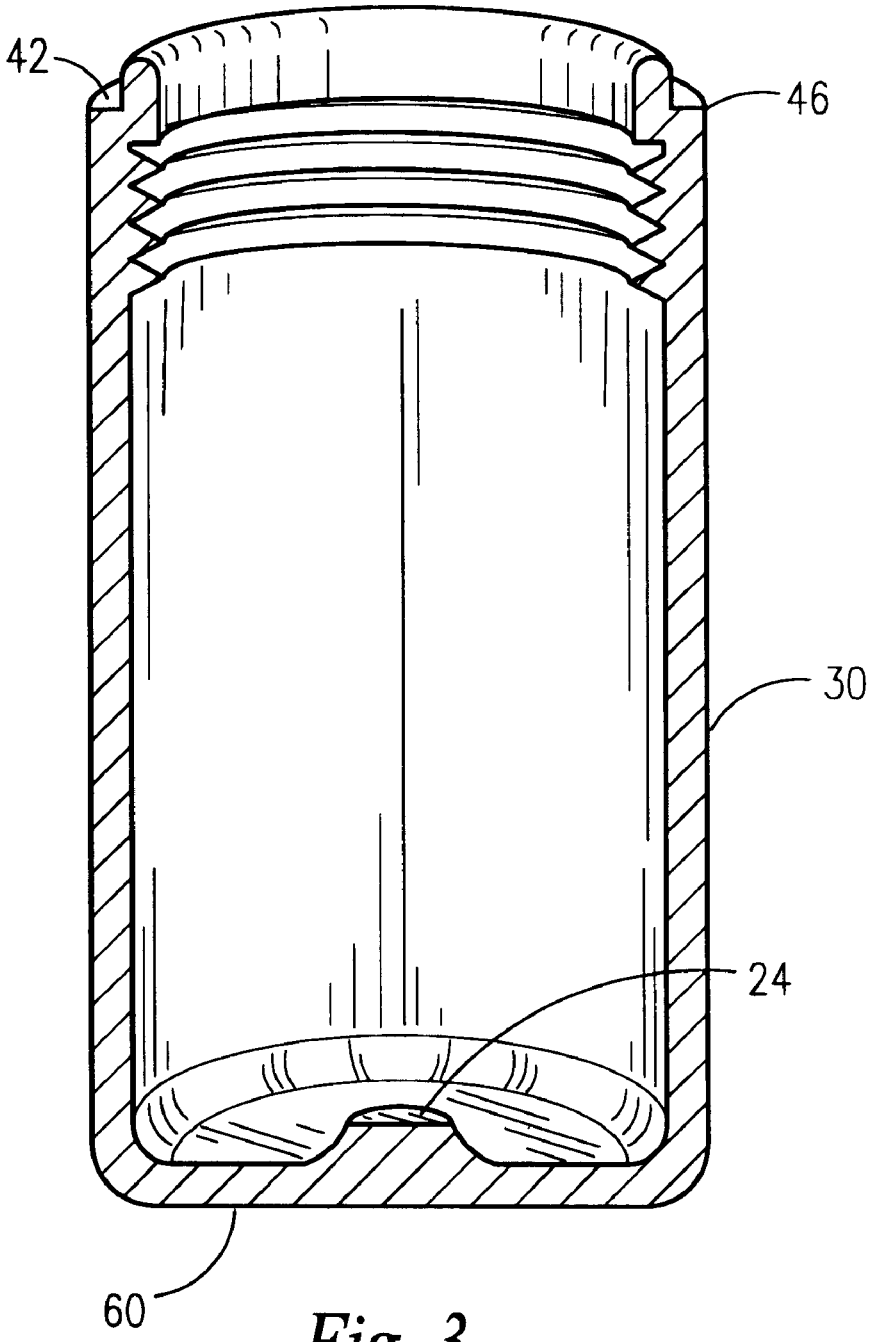
FIG. 3 is a side elevational view of an outer bottle wall.

Referring now to FIG. 1–3, a thermally insulated glass bottle 10 is shown, according to the preferred embodiment of the present invention. In this embodiment, the generally tubular inner glass wall 15 forms male connection threads 70 along the circumferential sidewall thereof. The neck 50 is tapered upward and inward to form a bottle opening, as shown. An outer sidewall 30 integrally includes a circular bottom support wall 60.

The tubular inner glass wall 15 is an insulated glass bottle with a cylindrical-shaped inner sidewall 20 and a substantially vertical circumferential sidewall 23.

The tubular inner glass wall 15 forms a hollow interior 25 circumscribed by an inner sidewall 20 designed to receive and hold beverages. The vertical circumferential sidewall 23 is inwardly offset relative to the outer sidewall 30 so as to insertably engage within the outer glass wall 30 along most of the vertical height. The inner sidewall 20 includes a circular bottom wall 22. In the event that additional vertical support is required for the tubular inner glass wall 15, it is envisioned that the lower circular bottom support wall 60 can optionally include an upwardly extending, integral support member 24 for providing structural integrity to the bottom wall 22, and thereby the inner sidewall 20 as well.

The inner sidewall 20 and the outer sidewall 30 are joined in a threaded fashion together so as to form a glass bottle, wherein an interstitial space 40 is defined between them which divides and thermally insulates the inner sidewall 20 along both the bottom wall 22 and circumferential sidewalls 23 thereof. Upon engagement of the outer sidewall 30 over and onto the tubular inner glass wall 15 a seal is formed to isolate the interstitial space 40, forming an isolated airspace. In order to provide such a seal, a first mating surface 42 for engaging with a second mating surface 44. The first mating surface 42 is shown as an upwardly extending protrusion from the upper peripheral opening of the outer sidewall 30. The protrusion is offset inward by a notch 46. In alignment with the first mating surface, the second mating surface is shown as an inwardly formed receiving cavity 48 circumscribing the vertical circumferential sidewall 23 of the inner glass wall 15. The receiving cavity 48 aligns with and receives the upwardly extending protrusion, such as when sealed will form a tortuous path to access the interstitial space 40. Additionally, a sealing member 49 can be placed within the receiving cavity 48. When formed of a clear pliable material, such as a deformable elastomer, when the receiving cavity 48 aligns with and receives the upwardly extending protrusion and tightened the sealing member 49 will deform, forcing against the available space and forming a hermetic seal of the interstitial space.

Although the threads can be formed within the outer sidewall 30, an alternate method-as known using a threaded insert formed separately of clear plastic or other formable material, for attachment into a receiving notch formed within the inner side of the outer sidewall 30. In this manner, with the threads are adhered thereto without the need of machining or other difficult or complicated manufacturing. It is also anticipated that, alternately, the outer sidewall 30 can be adhered or thermally formed directly to the tubular glass member 15 by a suitable bonding means including chemical or suitable adhesive or cohesive means as is known in the art for fusing in order to form a one-piece, non-separable unit.

According to such a design, the present invention can thereby be formed either of glass, or injected molded of plastic or similar material.

2. Operation of the Preferred Embodiment

To use the present invention, the user simply pours a desired beverage within the hollow interior 25 and drinks from the neck 50 of the present invention like any other glass bottle. The interstitial space 40 serves to insulate the beverage from the outer sidewall 30 of the glass bottle thus preventing condensation from forming thereon. The resulting functionality of the interstitial space 40 serves not only to keep beverages colder and to prevent a user's hands from warming the beverage, but also prevents slippage of the glass bottle from the user's hands.

The use of the present invention provides a means to enjoy a cold beverage without the aggravations and disadvantages of condensation or sweating.

Therefore, the foregoing description is included to, illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A thermally insulated bottle comprising:

a generally tubular member having an inner sidewall supporting a threaded connection along an upper portion near a neck, said neck tapered upward, and said tubular member having an outer sidewall integrally forming a circular bottom support wall and a cylindrical-shaped inner sidewall and a substantially vertical annular outer sidewall;

an outer sidewall;

said inner sidewall forming a hollow interior designed to receive beverages, said inner sidewall inwardly offset relative to the outer sidewall so as to insertably engage within said outer sidewall along most of a vertical height, wherein said inner sidewall and said outer sidewall are joined in a threaded fashion together so as to form a bottle, wherein an interstitial space is defined between them providing division and thermal insulation to said inner sidewall along both a bottom wall and circumferential sidewalls thereof; and a first mating surface for engaging with a second mating surface, said first mating surface being an extending protrusion from a peripheral rim of said outer sidewall and offset inward by a notch in alignment with said second mating surface being an inwardly formed receiving cavity circumscribing said vertical circumferential sidewall of said tubular member, wherein said receiving cavity aligns with and receives said extending protrusion, such as when sealed will form a tortuous path to access the interstitial space;

wherein upon engagement of said outer sidewall over and onto said tubular member a seal is formed to isolate said interstitial space, forming an isolated airspace.

2. The thermally insulated bottle of claim 1, further comprising a sealing member placed within said receiving cavity.

3. The thermally insulated bottle of claim 2, wherein said sealing member is formed of a pliable material.

4. The thermally insulated bottle of claim 1, wherein said threaded connection is integrally formed within said inner sidewall.

5. The thermally insulated bottle of claim 1, wherein said threaded connection comprises:

a threaded insert formed of a formable material for attachment into a receiving notch formed within said inner side of said outer sidewall.

6. The thermally insulated bottle of claim 1, wherein said threaded insert is formed of a clear material.

7. The thermally insulated bottle of claim 1, wherein said inner sidewall includes a circular bottom wall and forms an upwardly extending, integral support member for providing structural integrity to the bottom wall, and thereby the inner sidewall as well.

8. The thermally insulated bottle of claim 1, wherein said generally tubular member is formed of glass.

9. The thermally insulated bottle of claim 8, wherein said generally outer sidewall is formed of glass.

10. The thermally insulated bottle of claim 1, further comprising a decorative insulating material placed within said interstitial space.

11. The thermally insulated bottle of claim 1, wherein said generally tubular member is formed of glass.

12. The thermally insulated bottle of claim 8, wherein said generally outer sidewall is formed of glass.

* * * * *